US005932032A

United States Patent [19]

Roth

[11] Patent Number: 5,932,032

[45] **Date of Patent: *Aug. 3, 1999**

[54] PROCESS FOR THE PRODUCTION OF SOLID MAGNET BODIES

[75] Inventor: Stefan Roth, Dresden, Germany

[73] Assignee: Institut fuer Festkoerper-und Werkstofforschung Dresden e.V., Dresden, Germany

[ * ] Notice: This patent is subject to a terminal disclaimer.

[21] Appl. No.: 08/951,403

[22] Filed: Oct. 16, 1997

[30] Foreign Application Priority Data

Oct. 22, 1996 [DE] Germany ..... 196 43 602

[51] Int. Cl.[6] ..... H01F 1/14

[52] U.S. Cl. ..... 148/122; 148/121; 148/538; 148/579

[58] Field of Search ..... 148/100, 120, 148/121, 122, 538, 540, 579, 712

[56] References Cited

FOREIGN PATENT DOCUMENTS 450841 7/1936 United Kingdom .

*Primary Examiner*—John Sheehan
*Attorney, Agent, or Firm*—McAulay Nissen Goldberg Kiel & Hand, LLP

[57] ABSTRACT

A process by which solid magnet bodies can be efficiently produced from materials with soft magnetic properties using the die casting process is disclosed. The process is characterized in that an alloy comprising the alloy constituents of the soft magnetic material in addition to one or more elements lowering the melting point is used as a starting material, and in that the additional elements are at least partially extracted from the magnet bodies that are produced from this alloy by the die casting method subsequently by a heat treatment in a reactive atmosphere. The process is applicable for the production of soft magnetic magnet bodies for relays, transformers, magnet valves, actuators, and other electromagnetic products.

8 Claims, No Drawings

PROCESS FOR THE PRODUCTION OF SOLID MAGNET BODIES

BACKGROUND OF THE INVENTION a) Technical Field of the Invention

The invention is directed to a process for the production of solid magnet bodies from materials with soft magnetic properties using the method of die casting. The process is applicable for the production of soft magnetic magnet bodies for relays, transformers, magnet valves, actuators, and other electromagnetic products.

b) Description of the Related Art

It is already known to produce solid, soft magnetic magnet bodies by powder-metallurgical methods. In doing so, however, it is very complicated and often impossible to prevent pores in the finished articles. Pores, which are the source of internal shear, as it is called, cause extensive deterioration of the soft magnetic characteristics of high-grade materials. Powder-metallurgical methods are accordingly suitable for the manufacture of solid, soft magnetic magnet bodies only conditionally.

It is also known to produce solid, soft magnetic magnet bodies for electric machines using the precision casting method (DD 108 628). For this purpose, a mold must be produced for every individual cast article and must be removed from the cast article after casting in a laborious manner using aggressive auxiliary materials which generates waste. The precision casting method is therefore uneconomical for mass manufacture.

It is also already known to produce solid, soft magnetic magnet bodies for electric machines by the die casting method (DD 126 155). The die casting process which enables high productivity in principle has so far not been successful in practice for the production of solid, soft magnetic magnet bodies because, as a result of the high melting point of typical soft magnetic alloys, the die casting tools a very short life and manufacturing is accordingly uneconomical. Changing the alloy composition is impossible because of the deterioration of the magnetic properties associated with this change.

OBJECT AND SUMMARY OF THE INVENTION

The primary object of the invention is to provide a process by which solid magnet bodies can be efficiently produced from materials with soft magnetic properties using the die casting process.

The process for meeting this object is characterized in that an alloy comprising the alloy constituents of the soft magnetic material in addition to one or more elements lowering the melting point is used as a starting material, and in that the additional elements are at least partially extracted from the magnet bodies that are produced from this alloy by the die casting method subsequently by means of a heat treatment in a reactive atmosphere.

An alloy containing boron, carbon and/or phosphorus as the melting-point lowering elements can advisably be used as a starting material.

An alloy which contains the melting-point lowering elements in amounts such that the melting point of the alloy is reduced to a temperature of less than 1400° C., preferably less than 1300° C. is advantageously used as a starting material.

Hydrogen can be used as a reactive atmosphere for the heat treatment of the die-cast magnet bodies. In this connection, it is advantageous when the hydrogen atmosphere is renewed continuously or intermittently by flushing or sweeping during the heat treatment of the die-cast magnet bodies.

In accordance with an advantageous development of the process, the die-cast magnet bodies are first heat-treated in wet hydrogen at a temperature between 850° C. and 1000° C. and subsequently in dry hydrogen at a temperature between 1000° C. and 1250° C. For this purpose, the die-cast magnet bodies should be heat-treated at a temperature ranging from 870° C. to 950° C. for a period of 2 to 16 hours in wet hydrogen and finally at a temperature in the range from 1050° C. to 1120° C. for a period of at least 1.5 hours in dry hydrogen.

The invention provides the preconditions for effectively processing high-quality soft magnetic alloys with the die casting method to produce solid magnet bodies. No troublesome pores occur in the material during casting. Reusable casting molds can be used and the temperature of the casting melt can be reduced until the die casting tools have a sufficiently long life.

DESCRIPTION OF THE PREFERRED EMBODIMENTS

The invention is explained more fully in the following with reference to embodiment examples.

Example 1

Boron is added to a soft magnetic $Fe_{85}Si_{15}$ alloy having a melting point of 1420° C. in an amount such that a $Fe_{77.5}Si_{13.5}B_9$ alloy is formed whose melting point is still only 1160° C.

Rings having an outer ring diameter of 20 mm and a material thickness of 2×2 mm are cast from this alloy by the die casting process. A measurement of the coercive field strength or coercive force gives a $H_c$ value of greater than 1200 A/m. These rings are subsequently subjected to heat treatment at 1000° C. for a period of 8 h in wet hydrogen and are then subjected to heat treatment at 1100° C. for a period of 8 h in dry hydrogen. As a result of the heat treatments, the boron content in the rings is reduced to less than 0.1 % and approximately the original $Fe_{85}Si_{15}$ alloy with a coercive force $H_c$ of less than 100 A/m results.

The rings produced in this way can be used as ring cores in transformers.

Example 2

Boron is added to a soft magnetic $Fe_{49}Co_{49}V_2$ alloy having a melting point of 1480° C. in a mass proportion of 4.5%. The melting point of this alloy lies below 1100° C. Rods with a length of 25 mm and a thickness of 2 mm are cast from this alloy by the die casting method. A measurement of coercive force gives a $H_c$ value of greater than 1600 A/m.

These rods are subsequently subjected to heat treatment in wet hydrogen at 1000° C. for a period of 8 h and are then subjected to heat treatment in dry hydrogen at 1080° C. for a period of 8 h. As a result of the heat treatment, the boron content in the rods is reduced to less than 0.1% and approximately the original $Fe_{49}Co_{49}V_2$ alloy with a coercive force $H_c$ of less than 200 A/m results.

The rods produced in this way can be used as cores for relays.

While the foregoing description and drawings represent the preferred embodiments of the present invention, it will be obvious to those skilled in the art that various changes and modifications may be made therein without departing from the true spirit and scope of the present invention.

What is claimed is:

1. In a process for the production of solid magnet bodies from materials with soft magnetic properties using the method of die casting, the improvement comprising the steps of:

using, as a starting material, an alloy comprising the alloy constituents of a soft magnetic material in addition to at least one element lowering the melting point of the soft magnetic material; and at least partially extracting the additional element or elements from magnet bodies that are produced from this alloy by the die casting method by heat treatment in a reactive atmosphere.

2. The process according to claim 1, wherein an alloy containing at least one element selected from the group consisting of boron, carbon and phosphorus as the melting-point lowering elements is used as a starting material.

3. The process according to claim 1, wherein an alloy which contains the melting-point lowering elements in amounts such that the melting point of the alloy is reduced to a temperature of less than 1400° C. is used as a starting material.

4. The process according to claim 3, wherein the melting point is reduced to a temperature of less than 1300° C.

5. The process according to claim 1, wherein hydrogen is used as a reactive atmosphere for the heat treatment of the magnet bodies.

6. The process according to claim 5, wherein the hydrogen atmosphere is renewed continuously or intermittently by flushing during the heat treatment of the magnet bodies.

7. The process according to claim 1, wherein the magnet bodies are first heat-treated in wet hydrogen at a temperature between 850° C. and 1000° C. and are subsequently heat-treated in dry hydrogen at a temperature between 1000° C. and 1250° C.

8. The process according to claim 7 wherein the magnet bodies are heat-treated at a temperature in the range from 870° C. to 950° C. for a period of 2 to 16 hours in wet hydrogen and finally are heat-treated at a temperature in the range from 1050° C. to 1120° C. for a period of at least 1.5 hours in dry hydrogen.

* * * * *